US008611805B2

(12) United States Patent
Koike et al.

(10) Patent No.: US 8,611,805 B2
(45) Date of Patent: Dec. 17, 2013

(54) WASTE-TONER COLLECTING DEVICE PROCESS CARTRIDGE AND IMAGE FORMING APPARATUS HAVING THE SAME

(75) Inventors: Toshio Koike, Tokyo (JP); Ken Amemiya, Tokyo (JP); Satoshi Hatori, Kanagawa (JP); Yuji Arai, Kanagawa (JP); Yuta Azeyanagi, Kanagawa (JP); Michiya Okamoto, Kanagawa (JP); Takuma Iwasaki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 391 days.

(21) Appl. No.: 12/923,985

(22) Filed: Oct. 19, 2010

(65) Prior Publication Data

US 2011/0097124 A1 Apr. 28, 2011

(30) Foreign Application Priority Data

Oct. 27, 2009 (JP) ..... 2009-246067

(51) Int. Cl.
*G03G 21/00* (2006.01)

(52) U.S. Cl.
USPC ..... 399/358

(58) Field of Classification Search
USPC ..... 399/358, 360, 35
See application file for complete search history.

(56) References Cited

U.S. PATENT DOCUMENTS

| | | | | |
|---|---|---|---|---|
| 6,937,838 | B2 | 8/2005 | Ishii et al. | |
| 6,975,830 | B2 | 12/2005 | Murakami et al. | |
| 7,184,684 | B2 | 2/2007 | Murakami et al. | |
| 2007/0196148 | A1 * | 8/2007 | Shishikura | 399/358 |
| 2008/0226333 | A1 | 9/2008 | Ono et al. | |
| 2009/0097879 | A1 | 4/2009 | Nagashima et al. | |
| 2010/0080600 | A1 | 4/2010 | Okamoto et al. | |

FOREIGN PATENT DOCUMENTS

| | | |
|---|---|---|
| JP | 4-135415 | 6/2008 |
| JP | 2009-080473 | 4/2009 |

OTHER PUBLICATIONS

Machine English Translation of JP 2004-045451 published on Feb. 12, 2004.*
Abstract of JP2004-045451, published on Feb. 12, 2004.

* cited by examiner

*Primary Examiner* — Billy J Lactaoen
(74) *Attorney, Agent, or Firm* — Harness, Dickey & Pierce, P.L.C.

(57) ABSTRACT

A waste-toner collecting device includes a waste toner collector that collects and stores therein non-transferred toner as waste toner conveyed from a cleaning unit via the conveying path; and a leveling member that levels waste toner accumulated inside the waste toner collector, and drive of which is controlled so that driving conditions thereof are varied based on information of an image formed on the image carrier. The switching of the driving conditions of the leveling member is controlled so as to be performed after a delay time during which the non-transferred toner collected in the cleaning unit reaches the waste-toner collector via the conveying path.

7 Claims, 5 Drawing Sheets

WASTE-TONER COLLECTING DEVICE PROCESS CARTRIDGE AND IMAGE FORMING APPARATUS HAVING THE SAME

CROSS-REFERENCE TO RELATED APPLICATIONS

The present application claims priority to and incorporates by reference the entire contents of Japanese Patent Application No. 2009-246067 filed in Japan on Oct. 27, 2009.

BACKGROUND OF THE INVENTION

1. Field of the Invention

The present invention relates to a waste-toner collecting device for collecting non-transferred toner as waste toner remaining on an image carrier such as a photosensitive drum, a photosensitive belt, and an intermediate transfer belt, and to a process cartridge and an image forming apparatus provided with the same.

2. Description of the Related Art

In an electrophotographic image forming apparatus such as a copier, a printer, a facsimile, or a multifunction product of these devices, there has been conventionally known a technology for removing non-transferred toner (residual toner) deposited on an image carrier such as a photosensitive drum by a cleaning unit, conveying the non-transferred toner collected by the cleaning unit toward a waste-toner collecting device (a waste-toner collecting box or a waste-toner tank) via a conveying path, and collecting and storing the collected toner as waste toner inside of the waste-toner collecting device (e.g., see Japanese Patent No. 4135415 and Japanese Patent Application Laid-open No. 2009-80473).

When the waste-toner collecting device is full of the waste toner collected and stored inside thereof, the waste-toner collecting device is taken out from the body of the image forming apparatus and is replaced with new one. Here, because the waste toner (non-transferred toner) collected into the waste-toner collecting device is toner after it is used in a series of image forming processes, the waste toner has a low fluidity as compared with that of fresh toner before being used, and thus it is difficult to be uniformly accumulated inside the waste-toner collecting device and it is therefore easy to be locally accumulated. Once the waste toner is locally accumulated in the waste-toner collecting device, even though the waste toner in the waste-toner collecting device is not in a full state, a full-state detection sensor for detecting a full state of waste toner inside thereof incorrectly detects the state, which causes inconvenience that replacement-maintenance of the device is frequently required. Therefore, the waste-toner collecting device is generally provided with a leveling member (conveying member, screw auger) for leveling the waste toner accumulated inside thereof. More specifically, the waste toner collected, stored, and accumulated in the waste-toner collecting device is leveled by the leveling member to be uniformly accumulated inside of the waste-toner collecting device.

In the conventional waste-toner collecting device, an operating efficiency of the leveling member is low, and power consumption required for driving the leveling member may thereby be increased, or variations may occur in a leveled state of the waste toner inside thereof being leveled by the leveling member.

More specifically, the leveling member in the waste-toner collecting device is driven in association with an image forming operation performed on the image carrier. In other words, the drive of the leveling member is started at the same time when the image forming operation on the image carrier is started, and the drive of the leveling member is stopped at the same time when the image forming operation on the image carrier is finished. However, an amount of waste toner conveyed from the cleaning unit toward the waste-toner collecting device is largely different depending on an image area of an image formed on the image carrier. Therefore, if settings of driving conditions of the leveling member are uniformly fixed, power consumption required for driving the leveling member may be increased, or variations may occur in the leveled state of the waste toner in the device being leveled by the leveling member. More specifically, once the driving condition of the leveling member is set according to a large amount of the waste toner collected in the waste-toner collecting device, then the driving condition of the leveling member is more than required and the power consumption required for driving the leveling member is increased when a small amount of the waste toner is collected. On the other hand, once the driving condition of the leveling member is set according to a small amount of the waste toner collected in the waste-toner collecting device, then the leveling of the waste toner in the device is insufficient when a large amount of the waste toner is collected.

SUMMARY OF THE INVENTION

It is an object of the present invention to at least partially solve the problems in the conventional technology.

According to an aspect of the present invention, there is provided a waste-toner collecting device for collecting non-transferred toner as waste toner remaining on an image carrier. The waste-toner collecting device includes a waste toner collector that communicates with a cleaning unit for removing non-transferred toner from the image carrier via a conveying path, and collects and stores therein the non-transferred toner as waste toner conveyed from the cleaning unit via the conveying path; and a leveling member that levels waste toner accumulated inside the waste toner collector, and drive of which is controlled so that driving conditions thereof are varied based on information of an image formed on the image carrier. Switching of the driving conditions of the leveling member is controlled so as to be performed after a delay time during which the non-transferred toner collected in the cleaning unit reaches the waste-toner collector via the conveying path.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiment

Figure 1:
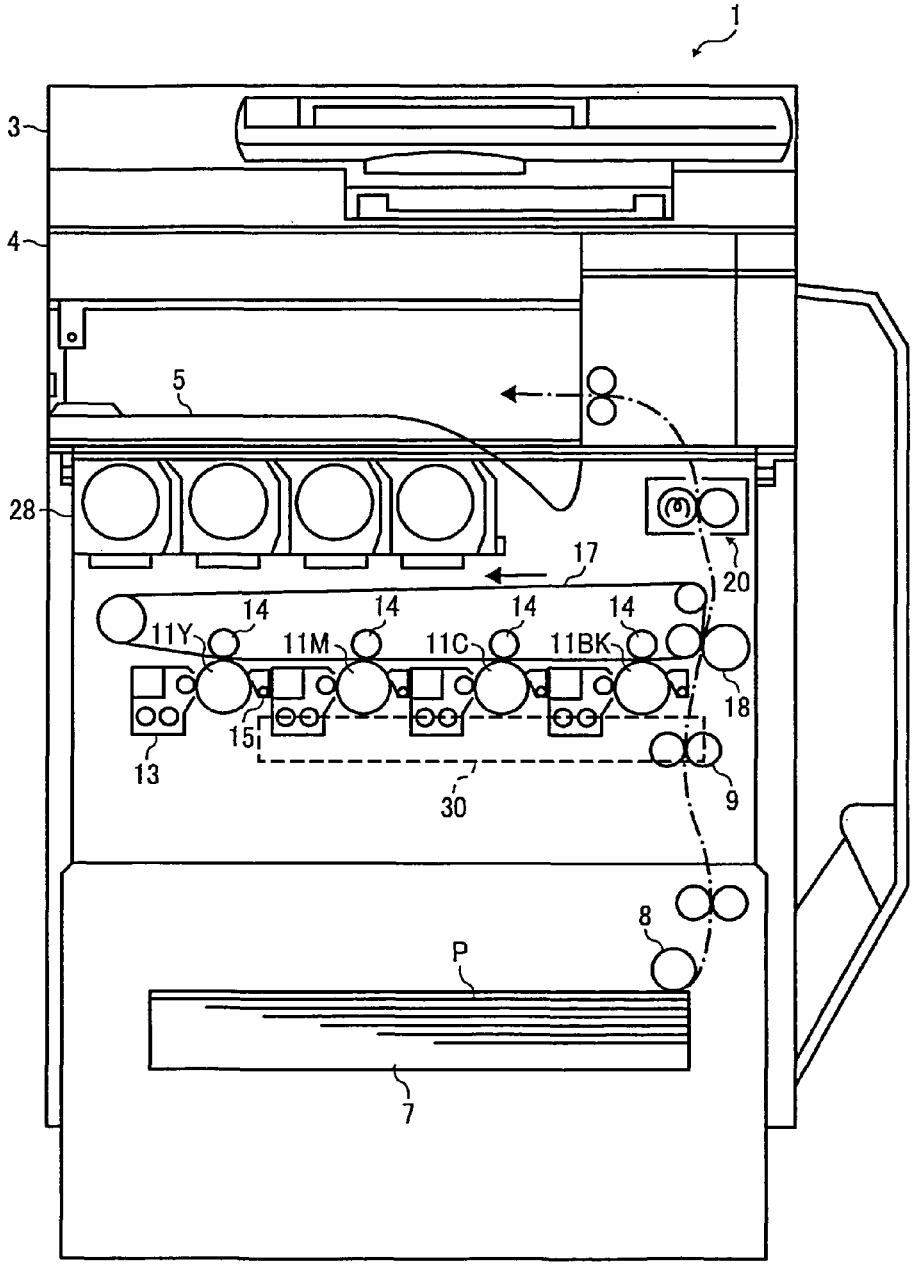
FIG. 1 is an entire configuration diagram of an image forming apparatus according to an embodiment of the present invention.

An embodiment of the present invention will be explained in detail below with reference to the accompanying drawings. In figures, the same reference numerals are assigned to portions the same as or corresponding to each other, and explanation thereof is simplified or omitted as required.

First, a configuration and operations of an entire image forming apparatus will be explained with reference to FIG. 1.

In FIG. 1, reference numeral 1 represents an apparatus body of a tandem color copier as the image forming apparatus; reference numeral 3 represents a document feeding unit for feeding a document to a document reading unit; reference numeral 4 represents the document reading unit for reading image formation of the document; reference numeral 5 represents a paper ejection tray where an output image is stacked; reference numeral 7 represents a paper feeding unit where a recording medium P such as a transfer paper is stored; reference numeral 9 represents a registration roller for adjusting a timing of conveying the recording medium P; reference numerals 11Y, 11M, 11C, and 11BK represent photosensitive drums as image carriers where toner images of colors (yellow, magenta, cyan, and black) are formed respectively; reference numeral 13 represents developing devices for developing electrostatic latent images formed on the photosensitive drums 11Y, 11M, 11C, and 11BK respectively; and reference numeral 14 represents transfer bias rollers (primary-transfer bias rollers) for transferring the toner images formed on the photosensitive drums 11Y, 11M, 11C, and 11BK to the recording medium P in a superimposing manner.

Moreover, reference numeral 17 represents an intermediate transfer belt to which the toner images of the colors are superposedly transferred; reference numeral 18 represents a secondary-transfer bias roller for transferring a color toner image on the intermediate transfer belt to the recording medium P; reference numeral 20 represents a fixing unit for fixing an unfixed image on the recording medium P; reference numeral 28 represents toner containers for the colors for supplying toners (new toners) of the colors (yellow, cyan, magenta, and black) to the developing devices 13, respectively; and reference numeral 30 represents a waste-toner collecting device for collecting non-transferred toner (residual toner), as waste toner, remaining on the photosensitive drums 11Y, 11M, 11C, and 11BK.

The operations in an ordinary color image formation performed by the image forming apparatus will be explained below. It should be noted that image forming processes performed on the photosensitive drums 11Y, 11M, 11C, and 11BK can be also referred to FIG. 2.

First, a feeding roller of the document feeding unit 3 feeds a document from a document table to be placed on a contact glass of the document reading unit 4. Then, the document reading unit 4 optically reads image information of the document placed on the contact glass.

More specifically, the document reading unit 4 scans an image of the document on the contact glass while irradiating the image with light emitted from an illumination lamp. The light reflected by the document is then imaged on a color sensor via a mirror group and lenses. Color image information of the document is read by the color sensor for each of color-separated lights of RGB (red, green, and blue), and is converted into electrical image signals. Furthermore, based on the color-separated image signals of RGB, processes such as a color conversion process, a color correction process, and a spatial-frequency correction process are performed by an image processing unit, and the color image information of yellow, magenta, cyan, and black is thereby obtained.

The image information of the respective colors of yellow, magenta, cyan, and black is transmitted to a writing unit (not shown). Laser lights L (see FIG. 2) based on the image information of the colors are emitted from the writing unit to the corresponding photosensitive drums 11Y, 11M, 11C, and 11BK, respectively.

Meanwhile, the four photosensitive drums 11Y, 11M, 11C, and 11BK rotate clockwise in FIG. 1. Each of the surfaces of the photosensitive drums 11Y, 11M, 11C, and 11BK is first uniformly charged at a portion facing a charging unit 12 (see FIG. 2) (which indicates a charging process). A charge potential is thereby formed on each of the photosensitive drums 11Y, 11M, 11C, and 11BK. Thereafter, each of the charged surfaces of the photosensitive drums 11Y, 11M, 11C, and 11BK reaches an irradiation position of a corresponding laser light.

The writing unit emits laser lights corresponding to image signals from four light sources according to the respective colors. The laser lights for color components of the yellow, magenta, can, and black pass through different light paths, respectively (which indicates an exposing process).

The laser light corresponding to the yellow component is irradiated to the surface of the photosensitive drum 11Y which is the first from the left in the drawing. At this time, the laser light of the yellow component is scanned, by a polygon mirror rotating at a high speed, in a rotation axis direction (main scanning direction) of the photosensitive drum 11Y. Thus, an electrostatic latent image corresponding to the yellow component is formed on the photosensitive drum 11Y after being charged by the charging unit 12.

Likewise, the laser light corresponding to the magenta component is irradiated to the surface of the photosensitive drum 11M which is the second from the left in the drawing, and an electrostatic latent image corresponding to the magenta component is formed thereon. The laser light corresponding to the cyan component is irradiated to the surface of the photosensitive drum 11C which is the third from the left in the drawing, and an electrostatic latent image corresponding to the cyan component is formed thereon. The laser light corresponding to the black component is irradiated to the surface of the photosensitive drum 11BK which is the fourth from the left in the drawing, and an electrostatic latent image corresponding to the black component is formed thereon.

Thereafter, the surfaces of the photosensitive drums 11Y, 11M, 11C, and 11BK where the electrostatic latent images of the colors are formed reach positions facing the developing devices 13, respectively. Then, the toners of the colors are supplied from the developing devices 13 to the photosensitive drums 11Y, 11M, 11C, and 11BK, respectively, and the latent images on the photosensitive drums 11Y, 11M, 11C, and 11BK are developed (which indicates a developing process).

Thereafter, the surfaces of the photosensitive drums 11Y, 11M, 11C, and 11BK after the developing processes reach portions facing the intermediate transfer belt 17, respectively. Here, the transfer bias rollers 14 are disposed at the respective portions so as to contact an inner peripheral surface of the intermediate transfer belt 17. The toner images of the colors formed on the photosensitive drums 11Y, 11M, 11C, and 11BK are sequentially and superposedly transferred to the intermediate transfer belt 17 at respective positions of the transfer bias rollers 14 (which indicates a primary transfer process). At this time, a slight amount of non-transferred toner which is not fully transferred to the intermediate transfer belt 17 remains on each of the photosensitive drums 11Y, 11M, 11C, and 11BK.

Each of the surfaces of the photosensitive drums 11Y, 11M, 11C, and 11BK after the transfer processes reaches a position facing a cleaning unit 15 (cleaning device). The cleaning unit 15 collects non-transferred toner remaining on each of the photosensitive drums 11Y, 11M, 11C, and 11BK (which indicates a cleaning process). The non-transferred toner collected (removed) by cleaning units 15Y, 15M, 15C, and 15BK (see FIG. 4) is collected and stored inside the waste-toner collecting device 30 via conveying paths 40. This will be explained in detail later.

Thereafter, each of the surfaces of the photosensitive drums 11Y, 11M, 11C, and 11BK passes through a decharging unit (not shown), so that a series of imaging processes performed on the photosensitive drums 11Y, 11M, 11C, and 11BK is finished.

The intermediate transfer belt 17 to (on) which the color toners on the photosensitive drums 11Y, 11M, 11C, and 11BK are superposedly transferred (carried) moves counterclockwise in the figure and reaches a position facing the secondary-transfer bias roller 18. The color toner images carried on the intermediate transfer belt 17 are then transferred to the recording medium P at the position facing the secondary-transfer bias roller 18 (which indicates a secondary transfer process).

Thereafter, the surface of the intermediate transfer belt 17 reaches a position of an intermediate-transfer-belt cleaning unit (not shown). The non-transferred toner deposited on the intermediate transfer belt 17 is collected by the intermediate-transfer-belt cleaning unit, and thus a series of transfer processes performed on the intermediate transfer belt 17 is finished.

The recording medium P conveyed to a space (which is a secondary transfer nip) between the intermediate transfer belt 17 and the secondary-transfer bias roller 18 is conveyed from the paper feeding unit 7 through the registration roller 9 and the like.

More specifically, the recording medium P fed from the paper feeding unit 7 that stores the recording medium P by a paper feeding roller 8 passes through a conveying guide, and is then guided to the registration roller 9. The recording medium P having reached the registration roller 9 is conveyed toward the secondary transfer nip at an appropriate timing.

The recording medium P with a full-color image transferred thereto is then guided to the fixing device 20. In the fixing device 20, the color image is fixed on the recording medium P at a nip between a fixing roller and a pressing roller.

The recording medium P after the fixing process is ejected, as an output image, to the outside of the apparatus body 1 by a paper ejection roller, is stacked on the paper ejection tray 5, and a series of image forming processes is thereby completed.

Next, the imaging unit and the waste-toner collecting device 30 in the image forming apparatus will be explained below with reference to FIG. 2 to FIG. 5.

Figure 2:
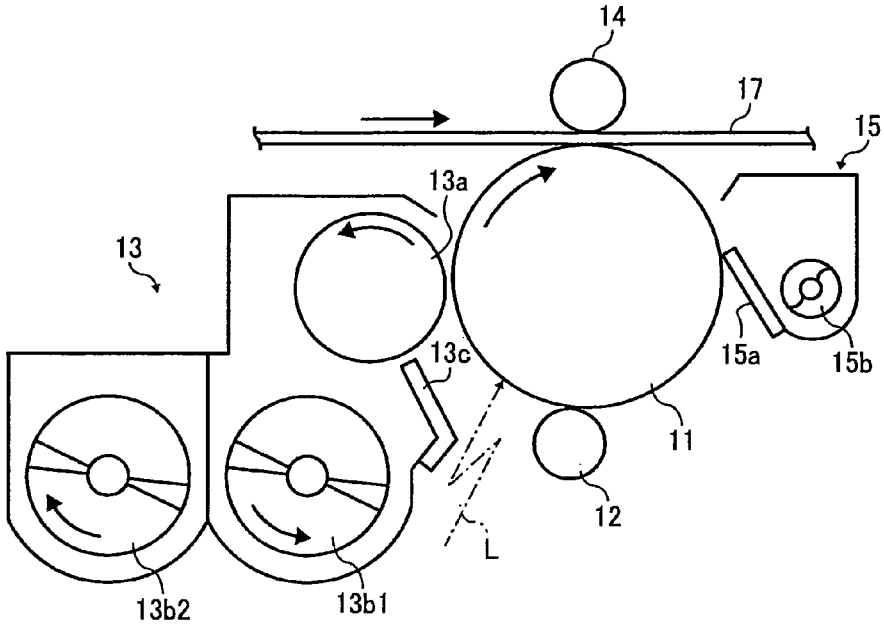
FIG. 2 is a configuration diagram of an imaging unit.
Figure 3:
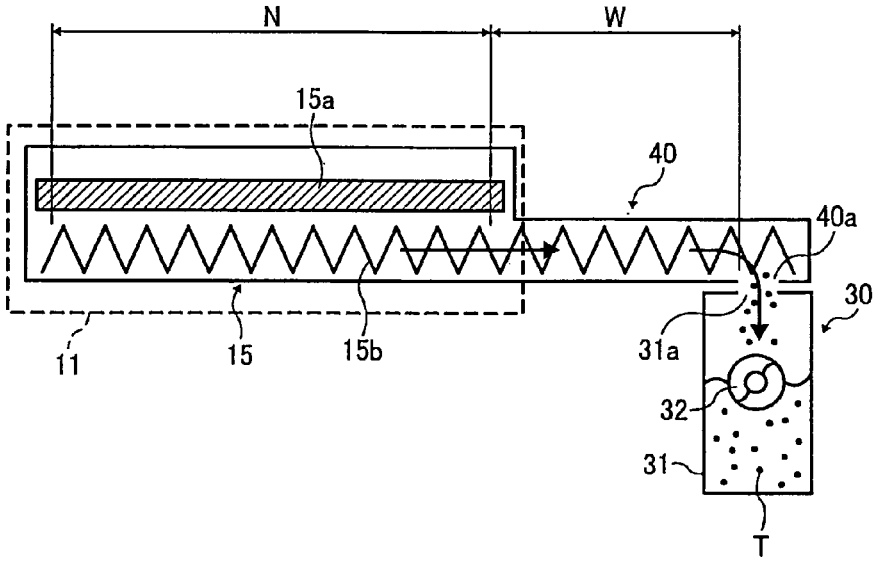
FIG. 3 is a schematic diagram of a waste-toner conveying path from a cleaning unit to a waste-toner collecting device when viewed from a longitudinal direction.
Figure 4:
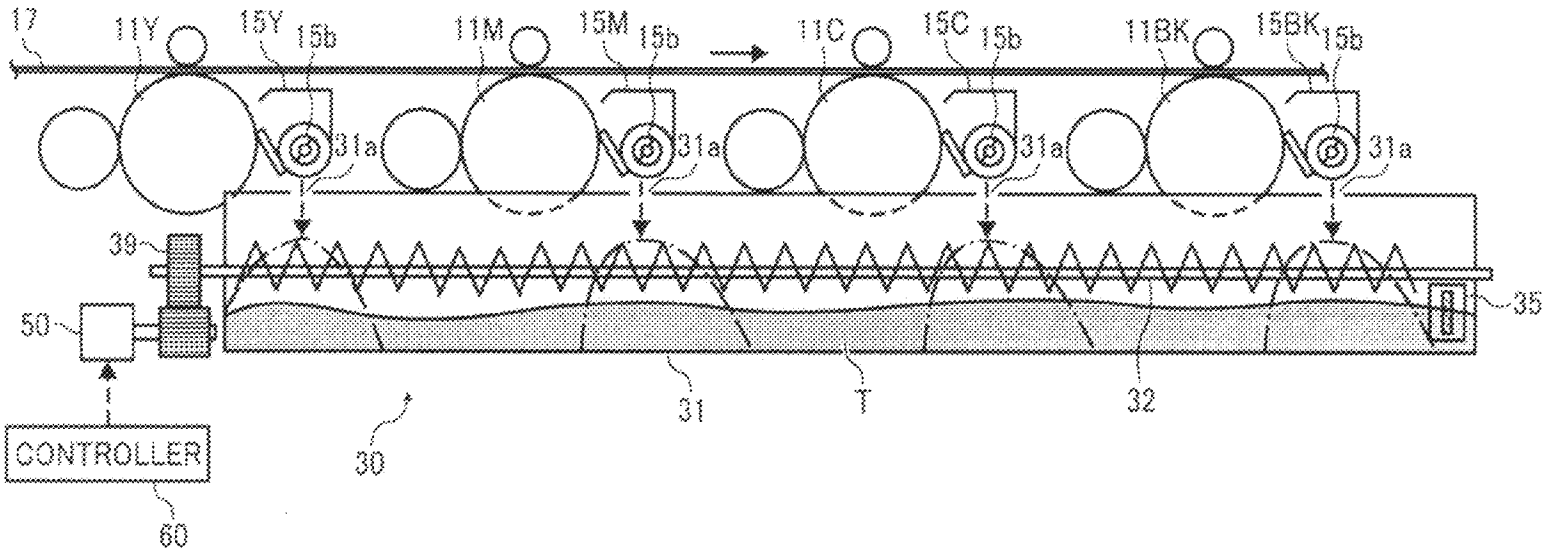
FIG. 4 is a configuration diagram of the waste-toner collecting device.
Figure 5A:
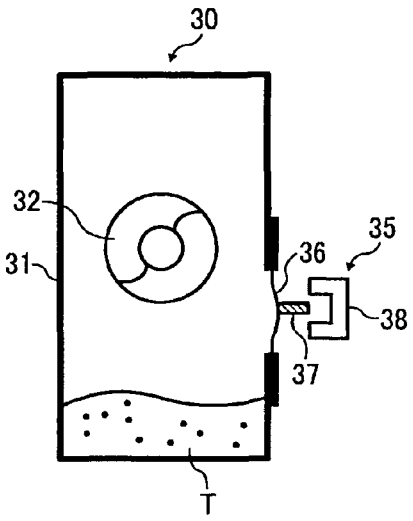
FIG. 5A is a diagram illustrating a state of a less amount of waste toner stored inside of the waste-toner collecting device.
Figure 5B:
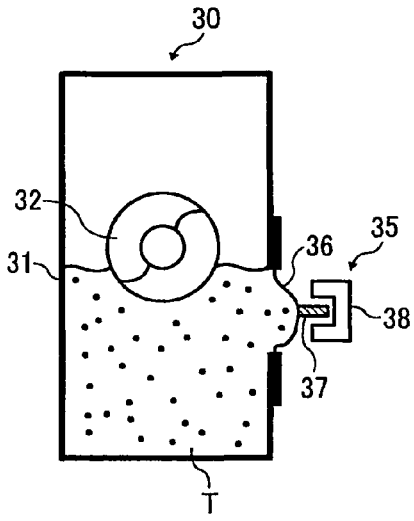
FIG. 5B is a diagram illustrating a state of a more amount of waste toner stored inside thereof.

FIG. 2 is a configuration diagram of the imaging unit. FIG. 3 is a schematic diagram when a waste-toner conveying path from the cleaning unit 15 to the waste-toner collecting device 30 is viewed longitudinally (which is the direction perpendicular to the plane of paper in FIG. 2). FIG. 4 is a configuration diagram of the waste-toner collecting device 30. FIG. 5A is a diagram illustrating a state of a less amount of waste toner stored inside of the waste-toner collecting device 30, and FIG. 5B is a diagram illustrating a state of a more amount of waste toner (a pre-full state) stored inside of the waste-toner collecting device 30.

Because imaging units have almost the same configuration as one another, the imaging unit and units such as the cleaning unit that form the imaging unit are shown without alphabetical letters (Y, C, M, and BK) arbitrarily in FIG. 2 to FIG. 5.

As shown in FIG. 2, the imaging unit includes the photosensitive drum 11 as an image carrier, the charging unit 12, the developing unit 13, and the cleaning unit 15 (cleaning device).

The photosensitive drum 11 as the image carrier is a negatively charged organic photosensitive element whose outer diameter is about 30 millimeters and is driven to rotate counterclockwise by a rotation drive mechanism (not shown).

The charging unit 12 is an elastic charging roller with a foamed urethane layer formed in a roller shape on its core bar. The foamed urethane layer has medium resistance and is formed of materials including urethane resin, carbon black as conductive particles, a sulfating agent, a foaming agent, and the like. The material of the medium-resistance layer of the charging unit 12 that can be used includes a rubber material in which a conductive substance such as carbon black and metal oxide is dispersed into urethane, ethylene-propylene-diene polyethylene (EPDM), butadiene acrylonitrile rubber (NBR), silicone rubber, and isoprene rubber to adjust the resistance, and also includes a foamed material of these.

The cleaning unit 15 includes a cleaning blade 15*a* that is in sliding contact with the photosensitive drum 11, so that the cleaning unit 15 mechanically removes and collects non-transferred toner on the photosensitive drum 11. The non-transferred toner collected into the cleaning unit 15 is conveyed toward the waste-toner collecting device 30 via the conveying path 40 by a conveying screw 15*b* that is made to rotate in a predetermined direction.

The cleaning blade 15*a* is formed of a rubber material such as polyurethane rubber, silicone rubber, nitrile rubber, and chloroprene rubber, and is in contact with the surface of the photosensitive drum 11 at a predetermined angle and at a predetermined pressure. Attachment such as non-transferred toner remaining on the photosensitive drum 11 is mechanically scraped off by the cleaning blade 15*a* and is collected into the cleaning unit 15. Here, the attachment that is attached to the photosensitive drum 11 includes, in addition to the non-transferred toner, paper dust produced from the recording medium P (paper), discharge products produced on the photosensitive drum 11 during discharge performed by the charging unit 12, and additives added to toner. In this application, those including the substances are collectively called "non-transferred toner".

In the present embodiment, the cleaning blade 15*a* is made in contact with the photosensitive drum 11 in a counter direction with respect to the rotation direction thereof, however, it may be made in contact with the photosensitive drum 11 in a trailing direction with respect to the rotation direction thereof.

The developing unit 13 (developing device) includes a developing roller 13*a* carrying the developer thereon, two conveying screws 13*b*1 and 13*b*2 for circulating the developer inside the developing unit, and a doctor blade 13*c* for regulating the amount of the developer attracted onto the developing roller 13*a*.

The developing roller 13*a* is disposed so as to be close to the photosensitive drum 11, and a developing region (a developing nip portion) that a magnetic brush contacts is formed at a portion facing the photosensitive drum 11. A developer (two-component developer) consisting of toner and carrier is stored in the developing unit 13. The developing unit 13 develops an electrostatic latent image formed on the photosensitive drum 11 (to form a toner image (image)).

Referring to FIG. 1, the toner container 28 stores therein toner (new toner) to be supplied into the developing unit 13. More specifically, the toner is appropriately supplied from the toner container 28 toward inside of the developing unit 13 via a toner conveying tube (not shown) based on information of toner concentration (a ratio of the toner in the developer) detected by a magnetic sensor (not shown) disposed in the developing unit 13.

Information of supply of the toner is not limited to the information of the toner concentration, but the toner may be supplied based on the information of image density detected from reflectivity and the like of the toner image formed on the photosensitive belt, the intermediate transfer belt, or the like. It may also be determined to implement supply of the toner based on a combination of these different pieces of information.

The configuration and operations of the waste-toner collecting device 30 specific to the present embodiment will be explained in detail below.

Referring to FIG. 3 and FIG. 4, the waste-toner collecting device 30 includes a waste-toner collector 31, a screw member 32 (auger screw) as a leveling member, and a waste-toner pre-full detector 35 as a detection unit.

Referring to FIG. 3, the waste-toner collector 31 (waste-toner collection container) communicates with the cleaning units 15 via the conveying paths 40 (waste-toner conveying paths). The waste-toner collector 31 collects and stores therein the non-transferred toner, as waste toner T, conveyed from the cleaning units 15 via the conveying paths 40.

The image forming apparatus 1 according to the present embodiment is a tandem-type color image forming apparatus, which is provided with cleaning units 15Y, 15C, 15M, and 15BK that remove non-transferred toner from the photosensitive drums 11Y, 11C, 11M, and 11BK corresponding to the four colors, respectively (see FIG. 4). The waste toner T collected by the four cleaning units 15Y, 15C, 15M, and 15BK corresponding to the colors is collected and stored in the waste-toner collector 31 (waste-toner collecting device 30). More specifically, the waste toner T conveyed by the conveying paths 40 connected to the four cleaning units 15Y, 15C, 15M, and 15BK respectively is collected and stored in the waste-toner collector 31 via collection ports 31*a* from discharge ports 40*a* each of which is formed in a most downstream portion of the conveying path 40.

The waste-toner collecting device 30 is configured so as to be detachably attached to the apparatus body 1 of the image forming apparatus. When the waste toner T stored in the waste-toner collector 31 becomes in a full state, an open/close door (not shown) formed as part of an external cover of the apparatus body 1 is opened, the attached waste-toner collecting device 30 with the waste toner in the full state is detached therefrom, and an empty waste-toner collecting device 30 is replaced and attached thereto instead.

Referring to FIG. 3, the conveying path 40 is formed with a conveying tube and the conveying screw 15*b* installed inside the conveying tube. The conveying screw 15*b* is formed by winding spiral coil (or screw) around its shaft portion, and is extended from inside of the cleaning unit 15 into the conveying path 40. Formed in the most downstream portion of the conveying path 40 is the discharge port 40*a* communicating with the collection port 31*a* of the waste-toner collector 31. The waste toner T (non-transferred toner) collected by the cleaning unit 15 is conveyed in an arrow direction in FIG. 3 through rotatable drive of the conveying screw 15*b*, drops by its own weight from the discharge port 40*a* of the conveying path 40, and is then collected and stored inside the waste-toner collector 31 through the Collection port 31*a* (which indicates movement of the toner in the arrow direction in FIG. 3).

The conveying screw 15*b* is rotatably driven by a drive force transmitted from a main motor (not shown) that drives the photosensitive drum 11 via a line of gears. That is, the conveying screw 15*b* is caused to start or stop its rotatable drive in association with a start or a stop of the drive of the photosensitive drum 11.

Referring to FIG. 3 and FIG. 4, the screw member 32 (auger screw) as the leveling member is formed by winding spiral coil (or screw) around its shaft portion, and both ends of the shaft portion are rotatably supported by the waste-toner collector 31 via bearings. Provided around the bearings that support the screw member 32 is seal material so that the waste toner T stored in the waste-toner collector 31 is not leaked from hole portions where the bearings are disposed.

A gear 39 is provided at one end of the shaft portion of the screw member 32, and the drive force of a drive motor 50 fixed to the apparatus body 1 is transmitted to the screw member 32 via the gear 39. Thus, the screw member 32 (leveling member) is driven to rotate in a predetermined direction to level the waste toner accumulated inside the waste-toner collector 31.

More specifically, referring to FIG. 4, if the screw member 32 is not provided, the waste toner T having dropped by its own weight from the collection port 31*a* is accumulated into a heap as it is in the lower portion (see areas indicated by dotted lines in FIG. 4). If the waste toner is locally accumulated in this manner inside the waste-toner collector 31, the waste-toner pre-full detector 35 (full-state detection sensor) for detecting a full state of the waste toner therein detects erroneously, despite the fact that the waste toner in the waste-toner collector 31 is not in the full state, which frequently requires replacement-maintenance of the waste-toner collecting device 30.

In contrast, when the screw member 32 is provided, the waste toner T having dropped by its own weight from the collection port 31*a* is not locally accumulated into a heap as it is in the lower portion, but is stirred by the screw member 32, so that the waste toner T is accumulated at a nearly uniform height inside the waste-toner collector 31 as indicated by the solid line in FIG. 4. Therefore, occurrence of the above-mentioned inconvenience can be prevented.

In the present embodiment, the drive of the screw member 32 (leveling member) is controlled so that the driving conditions are varied based on the information of an image (toner image) formed on the photosensitive drum 11.

More specifically, if the image area of the image (toner image) formed on the photosensitive drum 11 is large, an amount of non-transferred toner remaining on the photosensitive drum 11 becomes also large, and thus a more amount of waste toner T is finally conveyed to the waste-toner collector 31 and is accumulated therein. Therefore, by increasing the driving rate per unit time of the screw member 32 (which indicates a ratio of time when it is intermittently driven) for rotatable driving, the leveling force by the screw member 32 is enhanced, and the waste toner T is thereby uniformly accumulated in the waste-toner collector 31. In contrast, if the image area of the image (toner image) formed on the photosensitive drum 11 is small, an amount of non-transferred toner remaining on the photosensitive drum 11 becomes also small, and thus a less amount of waste toner T is finally conveyed to the waste-toner collector 31 and is accumulated therein. Therefore, by decreasing the driving rate per unit time of the screw member 32 for rotatable driving, the leveling force by the screw member 32 is weakened, and the waste toner T is thereby uniformly accumulated in the waste-toner collector 31.

The image area of the image formed on the photosensitive drum 11 can be determined from a duty of a laser light L irradiated from a writing unit onto the photosensitive drum 11 during image formation. The image area is determined by a computing unit of a controller 60, and the driving condition (driving rate) of the screw member 32 is variably controlled by the controller 60 based on the computed result.

In the present embodiment, switching of the driving conditions of the screw member 32 (leveling member) is controlled so as to be performed after a delay time during which the non-transferred toner collected in the cleaning unit 15 reaches the waste-toner collector 31 via the conveying path 40. For example, if the image area of the image formed on the photosensitive drum 11 is small in a job related to a previous image forming operation and if the image area of the image formed on the photosensitive drum 11 is large in a job related to a current image forming operation, the switching of the driving conditions is performed from the state of a low driving rate per unit time of the screw member 32 to the state of a high driving rate thereof. However, the switching of the driving conditions is performed after a delay time during which the waste toner moves through an area W of the conveying path shown in FIG. 3.

Thus, the waste toner in the waste-toner collector 31 is made stably uniform by the screw member 32 regardless of the amount of the waste toner conveyed toward inside of the waste-toner collector 31, which allows comparatively low power consumption to drive the screw member 32 and improvement of the operation efficiency of the screw member 32.

It should be noted that the drive control of the screw member 32 will be explained in further detail later.

Referring to FIGS. 5A and 5B, the waste-toner pre-full detector 35 as a detection unit includes a rubber sheet 36 (flexible member), a filler 37, and a photosensor 38 (photo interrupter).

The rubber sheet 36 is a sheet member formed of a rubber material which is flexible and elastic, and is provided so as to block an opening formed in part of the waste-toner collector 31. The filler 37 is adhesively attached to the rubber sheet 36 at an external position of the waste-toner collector 31. Furthermore, the photosensor 38 formed with a light-emitting element and a light-receiving element is fixed to the apparatus body 1 of the image forming apparatus at the position facing the filler 37.

The waste-toner pre-full detector 35 (detection unit) configured in the above manner is used to detect that the waste toner T collected in the waste-toner collector 31 reaches a predetermined height. More specifically, as shown in FIG. 5A, when the amount of the waste toner T collected and stored in the waste-toner collector 31 is comparatively small, the load due to the waste toner T is not applied to the rubber sheet 36. Therefore, the filler 37 attached to the rubber sheet 36 is positioned apart from the photosensor 38, so that the state of the waste toner T that reaches the predetermined height (which indicates a pre-full state) is not detected by the photosensor 38. On the other hand, as shown in FIG. 5B, when the amount of the waste toner T collected and stored in the waste-toner collector 31 becomes larger, the load due to the waste toner T is applied to the rubber sheet 36. Therefore, the filler 37 attached to the rubber sheet 36 reaches the position of the photosensor 38 according to deformation of the rubber sheet 36, so that the light emitted from the light-emitting element toward the light-receiving element in the photosensor 38 is blocked, and the state of the waste toner T that reaches the predetermined height (which indicates a pre-full state) is detected.

In the present embodiment, when the waste toner T stored in the waste-toner collector 31 is in the pre-full state (near the full state) is detected by the waste-toner pre-full detector 35 (detection unit), a notice of the fact is displayed (warned) on a display unit (not shown) of the apparatus body 1. After the pre-full state is detected by the waste-toner pre-full detector 35, and the collecting operation of the waste toner T (drive operation of the screw member 32) is performed for a predetermined time, it is assumed that the waste toner T stored in the waste-toner collector 31 is in the full state, the apparatus body 1 is controlled so that the image forming operation cannot be performed in order to prevent the waste toner T from being leaked from the waste-toner collector 31, and a notice of the fact is displayed (warned) on the display unit.

The present embodiment is configured that the screw member 32 (leveling member) conveys the waste toner T collected in the waste-toner collector 31 toward the position of the waste-toner pre-full detector 35 (detection unit). More specifically, the screw member 32 conveys the waste toner T from the left side toward the right side in FIG. 4. The waste-toner pre-full detector 35 is disposed at an end portion of the downstream side (right side in FIG. 4) in the conveying direction of the waste toner T by the screw member 32.

With this configuration, the waste toner T is conveyed by the screw member 32 so as to be reliably pushed into the position of the waste-toner pre-full detector 35. Therefore, this configuration allows prevention of the inconvenience that the waste toner T is not conveyed to the position of the waste-toner pre-full detector 35, the waste-toner pre-full detector 35 cannot thereby detect the pre-full state, and that the waste toner T in the full state is poured out from the waste-toner collector 31.

The drive control of the screw member 32 (leveling member) performed in the waste-toner collecting device 30 will be explained in further detail below.

As previously explained, in the present embodiment, the drive of the screw member 32 (leveling member) is controlled so that the driving conditions are varied based on the information of the image formed on the photosensitive drum 11. Moreover, the switching of the driving conditions of the screw member 32 is controlled so that the switching is performed after a delay time during which the non-transferred toner collected in the cleaning unit 15 reaches the waste-toner collector 31 via the conveying path 40. More specifically, the switching of the driving conditions of the screw member 32 is performed after a delay time during which the waste toner T moves through the area W of the conveying path shown in FIG. 3 (which is an area from the position corresponding to the end portion of an image writing width N (maximum image area) on the side of the conveying path 40 in the cleaning unit 15 to the discharge port 40*a*).

This is because there is a time lag from when non-transferred toner on the photosensitive drum 11 is collected in the cleaning unit 15 to when the non-transferred toner as waste toner reaches the waste-toner collector 31. Therefore, even when information of an image area of the image (or an image-area ratio) formed on the photosensitive drum 11 is determined, there is no need to immediately vary the driving condition of the screw member 32 based on the determination.

For example, even if an image with a small image area has been formed and an image with a large image area is suddenly formed, a large amount of waste toner is not immediately discharged into the waste-toner collector 31. Therefore, in this case, the drive control is performed by keeping the driving rate of the screw member 32 low for a while, and this allows the waste toner T in the waste-toner collector 31 to be more effectively leveled without waste of consumed power related to the drive of the screw member 32. In contrast, even if an image with a large image area has been formed and an image with a small image area is suddenly formed, a large amount of waste toner is discharged into the waste-toner collector 31 for a while. Therefore, in this case, the drive control is performed by keeping the driving rate of the screw member 32 high for a while, and this allows the waste toner T in the waste-toner collector 31 to be more reliably leveled.

In the present embodiment, because the switching of the driving rates of the screw member 32 is performed after a delay time during which the waste toner moves through the area W of the conveying path, the waste toner T in the waste-toner collector 31 can be effectively and reliably leveled without waste of consumed power related to the drive of the screw member 32. The area W of the conveying path 40 is different depending on each model of the image forming apparatus 1. If the area W is longer, then a time lag for performing the switching of the driving rates of the screw member 32 becomes naturally larger.

The time (delay time) during which the waste toner moves through the area W of the conveying path 40 can be determined by experimentally checking the time until the waste toner is discharged from the cleaning unit 15 toward the waste-toner collecting device 30 in a state in which the conveying path 40 is empty.

Figure 6:
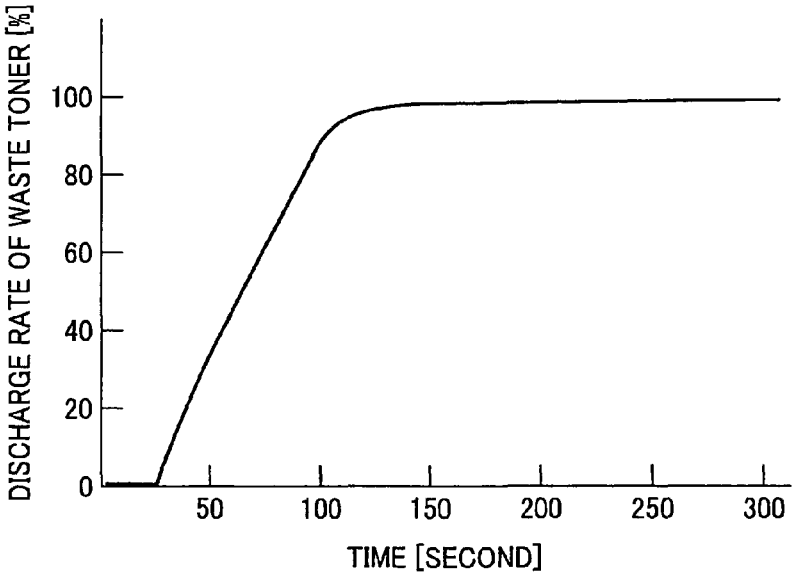
FIG. 6 is a graph representing a relation, when the waste toner is conveyed from the cleaning unit toward the waste-toner collecting device in a state of an empty conveying path, between a time since the start of conveying the waste toner and a discharge rate of the waste toner discharged toward a collection port of the waste-toner collecting device.

FIG. 6 is a graph representing a relation between a time (x-axis) having passed since a start of conveyance of waste toner when it is conveyed from the cleaning unit 15 (in which 10-gram waste toner is stored) toward the waste-toner collecting device 30 in a state in which the conveying path 40 is empty, and a discharge rate (y-axis) of the waste toner discharged toward the collection port 31*a* of the waste-toner collector 31.

As shown in FIG. 6, in the image forming apparatus according to the present embodiment, a time from a start of conveyance of waste toner from the cleaning unit 15 toward the waste-toner collecting device 30 to a start of discharge of the waste toner from the discharge port 40*a* into the waste-toner collector 31 was about 20 seconds. Therefore, in the present embodiment, the switching of the driving rates of the screw member 32 is performed after a delay time of about 20 seconds.

The time during which the waste toner moves through the area W of the conveying path 40 changes if the length of the area W of the conveying path 40 and the conveying force by the conveying screw 15*b* are changed. Therefore, it is necessary to determine a time during which the waste toner moves through the area W of the conveying path 40 for each model of the image forming apparatus 1.

The timing at which the non-transferred toner remaining on the photosensitive drum 11 is to be collected into the cleaning unit 15 can be determined by adding a time obtained by dividing a distance from a writing position of the photosensitive drum 11 to a position of the cleaning unit 15 by a linear velocity of the photosensitive drum 11, to a timing at which writing from the writing unit to the photosensitive drum 11 for a sheet of recording medium P is finished.

More specifically, in the present embodiment, an outer diameter of the photosensitive drum 11 is set to 30 millimeters; a linear velocity on an outer periphery of the photosensitive drum 11 is set to 120 mm/sec; and a distance from a writing position of the photosensitive drum 11 to a position of the cleaning unit 15 is set to 250°/360°. Therefore, the time from when writing to the photosensitive drum 11 is finished to when a latent image thereof (thereafter, the latent image is visualized at the position of the developing unit, and becomes non-transferred toner at the position of the transfer unit) reaches the cleaning unit is 0.55 seconds. Then the time from when the writing to the photosensitive drum 11 is finished to when discharge of the waste toner from the discharge port 40*a* of the conveying path 40 into the waste-toner collector 31 is started is 20.55 seconds (=20 sec+0.55 sec).

When sheets of paper are continuously fed, used as "the image area of an image formed on the photosensitive drum 11" used for the control may be an image area of an image to be formed on a specific sheet of recording medium P (for example, an image to be formed on a lastly fed recording medium P) in a series of image forming operations of continuous feeding of sheets, or an average value of image areas of images to be formed on a few sheets of recording medium P (or all the recording media P) in the series of image forming operations of the continuous feeding of sheets.

In the present embodiment, the drive of the screw member 32 is started or stopped in association with a start or an end of a series of image forming operations performed on the photosensitive drum 11. And during a period from the start of the drive to a passage of the delay time (time corresponding to the time that the non-transferred toner moves through the conveying path 40), the drive control is performed at the same driving condition as the last driving condition applied in a previous series of image forming operations.

Figure 7:
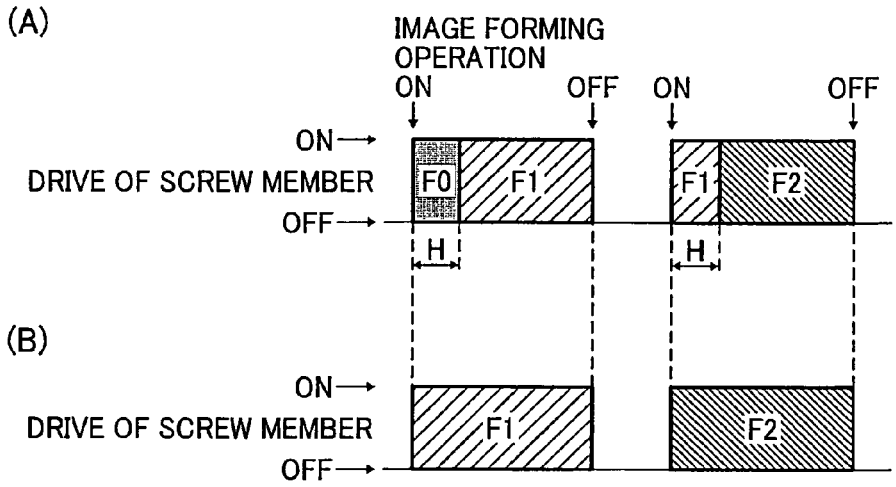
FIG. 7 illustrates timing charts representing drive control of (A) a leveling member according to the present embodiment and (B) a conventional leveling member.

More specifically, referring to (A) of FIG. 7, it is assumed that, in the previous series of image forming operations, the screw member 32 has been driven on a predetermined driving condition F1 (which indicates, for example, a lowest driving rate) after a delay time H passes. In this case, in the series of image forming operations performed this time, the screw member 32 is driven on a predetermined driving condition F2 (which indicates, for example, a highest driving rate) based on the image area of an image formed thereon after the delay time H passes. For the time until the drive control on the driving condition F2 is started (which is a time period from a start of the drive of the screw member 32 to an end of the delay time H), the screw member 32 is driven on the previous driving condition F1.

By performing such controls, the leveling operation by the screw member 32 can be efficiently performed according to the amount of waste toner, which remains in the conveying path 40 through the previous series of image forming operations and is to be discharged into the waste-toner collector 31, right after the start of the drive of the screw member 32, irrespective of the time lag (which is a time lag related to the area W of the conveying path 40) during which the non-transferred toner collected into the cleaning unit 15 is conveyed through the conveying path 40 and, as waste toner, reaches the waste-toner collector 31.

Additional explanation is further made.

The drive operation of the screw member 32 (leveling member) is in synchronization with the image forming operation on the photosensitive drum 11, and thus, the drive operation is finished when the image forming operation is finished.

As shown in (B) of FIG. 7, the control is assumed to be provided in such a manner that when an image forming operation is started, a detection result of an image area in the image forming operation at that time is immediately reflected to vary the driving conditions of the screw member 32, and the drive operation is started. In the case where such a control is provided, if it is determined, at a start time of the image forming, operation, that the image area is large and the amount of waste toner is large, the drive of the screw member 32 is controlled immediately, in response to the determination, on the driving condition F1 which is adequate to the case of the large amount of waste toner. Then, the image forming operation is finished while the determination as the large amount of waste toner is kept as it is, and at the same time, the drive operation of the screw member 32 is stopped. Next, when the image forming operation is restarted, an image area is detected in response to start of the image forming operation. For example, when it is detected from the detection result that the amount of waste toner is small, then the drive control of the screw member 32 is set to the driving condition F2 adequate to the case of the small amount of waste toner, immediately in response to the detection. Therefore, the screw member 32 is driven with inefficiency during a period corresponding to the time that the non-transferred toner collected in the cleaning unit 15 is conveyed through the conveying path 40 and, as the waste toner, reaches the waste-toner collector 31.

In contrast, in the present embodiment, the drive control of the screw member 32 is performed after a delay time from when an image forming operation is started and an image area of the image formed in the image forming operation is detected to when the waste toner is conveyed from the cleaning unit 15 to the waste-toner collector 31. Therefore, when the image forming operation is started and it is detected that the amount of waste toner is large, then the drive control of the screw member 32 is performed at the driving condition for the case of the large amount of waste toner, after a delay time during which the waste toner is conveyed from the cleaning unit 15 to the waste-toner collector 31. Then, the image forming operation is finished while the detection as the large amount of waste toner is kept as it is, and at the same time, the drive operation of the screw member 32 is also stopped. Next, even when the image forming operation is restarted and it is determined from the detection result of the image area that the amount of waste toner is small, the drive control of the screw member 32 is not immediately started at the driving condition for the case of the small amount of waste toner. At this time, during a period from the start of the drive of the screw member 32 to the end of the time corresponding to the delay time H, the drive control of the screw member 32 is performed at the driving condition for the case of the small amount of waste toner based on a history (which is information of image areas) upon the previous image forming operation. More specifically, referring to (A) of FIG. 7, a total time during which the screw member 32 is driven on the driving condition F1 based on the information of the image area upon the previous image formation is a sum of the time during which the screw member 32 is driven on the driving condition F1 in the previous image formation and the time H during which the screw member 32 is driven on the driving condition F1 upon the start of drive in the image formation this time. This is equivalent to the total time, referring to (B) of FIG. 7, during which the screw member 32 is driven on the driving condition F1 based on the information of the image area upon the previous image formation. Therefore, an optimal leveling operation by the screw member 32 is appropriately performed at an optimal timing and for an optimal period of time.

In the present embodiment, the driving condition of the screw member 32 which is made variable by the above-described control is "driving rate per unit time" of the screw member 32.

Figure 8:
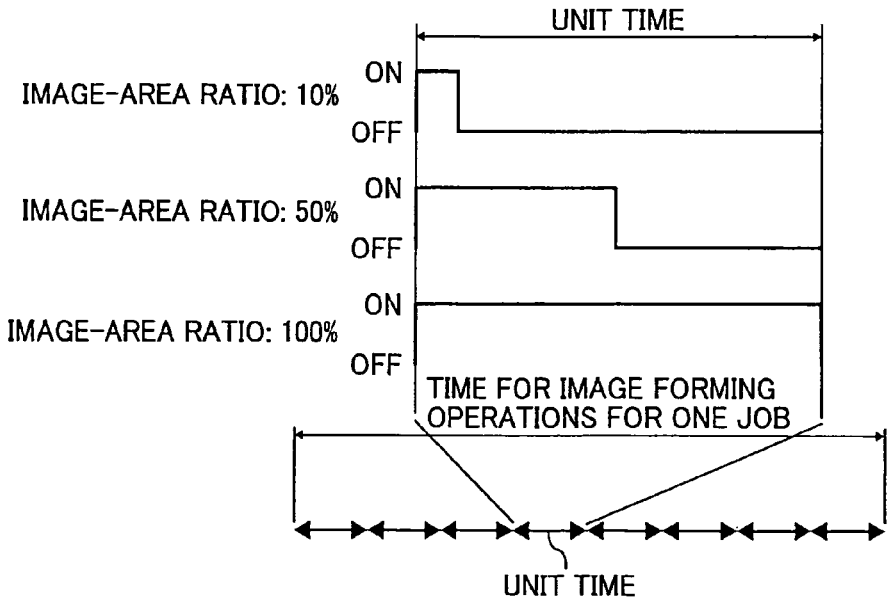
FIG. 8 is a diagram representing drive control in which the driving conditions of the leveling member are varied.

Referring to FIG. 8, the "driving rate per unit time" is a ratio (duty) of driving time of the screw member 32 intermittently driven for each unit time (which is set to one second in the present embodiment) with respect to the unit time. The "driving rate per unit time" of the screw member 32 is determined based on the image area of the image formed on the photosensitive drum 11. In the present embodiment, as an alternative characteristic of the "image area", there is used an image-area ratio (which is a value obtained by dividing the image area of an image formed on the recording medium P (photosensitive drum 11) by the size of the recording medium P). A value obtained by multiplying the unit time by the image-area ratio of the image formed on the photosensitive drum 11 is set as "driving rate per unit time".

More specifically, referring to FIG. 8, if the image-area ratio is 10%, then the "driving rate per unit time" is set to 0.1 seconds (=1 sec×10%), if the image-area ratio is 50%, then the "driving rate per unit time" is set to 0.5 seconds (=1 sec×50%), and if the image-area ratio is 100%, then the "driving rate per unit time" is set to 1.0 seconds (=1 sec× 100%). The intermittent driving of the screw member 32 is preformed for each unit time during the series of image forming operations (image forming operations for one job) based on the determined driving rate.

In the present embodiment, the driving condition of the screw member 32 which is varied by the above-described control is set as the "driving rate per unit time" of the screw member 32. However, the driving condition of the screw member 32 to be varied can be also set as a rotational speed of the screw member 32. Namely, a speed variable type motor is used as a drive motor 50 for rotatably driving the screw member 32. Then, the drive of the motor is controlled so that the rotational speed of the screw member 32 is made high when the image area of the image formed on the photosensitive drum 11 is large and the rotational speed of the screw member 32 is made low when the image area of the image formed on the photosensitive drum 11 is small. The high or low rotational speed of the screw member 32 is correlated to large or small leveling force by the screw member 32, similarly to a long or short period of the driving time of the screw member 32. Therefore, even if the driving condition of the screw member 32 to be varied is set to the rotational speed of the screw member 32, the same effect as that of the present embodiment can be obtained.

In the present embodiment, as shown in FIG. 4, the four photosensitive drums 11Y, 11C, 11M, and 11BK are arranged so as to be opposed to the intermediate transfer belt 17, and the cleaning units 15Y, 15C, 15M, and 15BK for removing non-transferred toner from the photosensitive drums 11Y, 11C, 11M, and 11BK are disposed respectively. All the non-transferred toner collected by the four cleaning units 15Y, 15C, 15M, and 15BK is collected and stored in the single waste-toner collecting device 30.

In the waste-toner collecting device 30 configured in the above manner, it is preferable to provide control so that the switching of the driving conditions of the screw member 32 is performed after a delay time required for a photosensitive drum 11, among the photosensitive drums 11Y, 11C, 11M, and 11BK, with a shortest time from when the non-transferred toner is collected in the corresponding cleaning unit 15Y, 15C, 15M, or 15BK to when the collected non-transferred toner reaches the waste-toner collector 31 via the conveying path 40. More specifically, in the present embodiment, during the series of the image forming operations, the non-transferred toner remaining on the photosensitive drum 11Y for yellow which is provided in the most upstream side (the most upstream side with respect to the moving direction of the intermediate transfer belt 17) among the four photosensitive drums 11Y, 11C, 11M, and 11BK is most quickly collected and stored in the waste-toner collector 31 through the collection port 31*a*. Therefore, the control is provided so as to perform the switching of the driving conditions of the screw member 32 after a delay time during which the non-transferred toner collected in the cleaning unit 15Y for yellow reaches the waste-toner collector 31 via the conveying path 40.

By providing the control in the above manner, the leveling operation by the screw member 32 can be efficiently performed adequately to the amount of waste toner discharged into the waste-toner collector 31.

Furthermore, in the present embodiment, it is preferable to perform the drive control so that the driving conditions of the screw member 32 are varied based on the image area of an image formed on the photosensitive drum 11 on which the image area of the formed image is the largest, among the photosensitive drums 11Y, 11C, 11M, and 11BK.

More specifically, the controller 60 calculates image-area ratios of images newly formed on the photosensitive drums 11Y, 11C, 11M, and 11BK after the image forming operation is started, determines a driving rate per unit time of the screw member 32 matching the largest image-area ratio among the calculated image-area ratios, and performs the drive control.

For example, it is assumed, in the series of image forming operations, that the image-area ratio of the image formed on the photosensitive drum 11BK for black is 10%, the image-area ratio of the image formed on the photosensitive drum 11C for cyan is 5%, the image-area ratio of the image formed on the photosensitive drum 11M for magenta is 5%, and the image-area ratio of the image formed on the photosensitive drum 11Y for yellow is 5%. In these cases, the driving rate per unit time of the screw member 32 is set to 0.1 seconds (=1 sec×10%) based on 10%-image-area ratio as a maximum. Then, the intermittent driving of the screw member 32 for each unit time is performed during the series of image forming operations (image forming operations for one job) based on the determined driving rate.

By providing the control in the above manner, the leveling operation by the screw member 32 can be efficiently performed adequately to the amount of waste toner discharged into the waste-toner collector 31.

As explained above, in the present embodiment, the drive control is performed so that the driving conditions of the screw member 32 (leveling member) are varied based on the information of the image formed on the photosensitive drum 11 (image carrier), and the control is also provided so that the switching of the driving conditions of the screw member 32 is performed after a delay time during which non-transferred toner T (waste toner) collected in the cleaning unit 15 reaches the waste-toner collector 31. Thus, the waste toner T in the waste-toner collector 31 is stably made uniform by the screw member 32 irrespective of the amount of waste toner conveyed into the waste-toner collector 31, the power consumption to drive the screw member 32 is comparatively low, and the operation efficiency of the screw member 32 can be enhanced.

In the present embodiment, the present invention is applied to the image forming apparatus in which the waste-toner collecting device 30 is configured as a single unit that is detachably attached to the apparatus body 1 of the image forming apparatus. However, the application of the present invention is not limited thereto, and therefore, the present invention is obviously applicable to any image forming apparatus in which the waste-toner collecting device 30 is formed as a process cartridge together with part of or the entire of the imaging units. In this case, the operability of maintenance of the imaging units and the waste-toner collecting device 30 can be improved.

In this application, the "process cartridge" is defined as a unit in which the image carrier and at least one of the charging unit for charging the image carrier, the developing unit for developing the latent image formed on the image carrier, and the cleaning unit (cleaning device) for cleaning the image carrier are integrated, and the unit being detachably attached to the body of the image forming apparatus.

Moreover, the present embodiment uses the screw member 32 (auger screw) as the leveling member. However, a coil member formed of a spiral coil which is rotatably driven in the spiral direction can be used as the leveling member, and a stirring member having a blade member which is formed on a shaft portion thereof and rotatably driven around the shaft portion can also be used as the leveling member.

Even in these cases, the same effect as that of the present embodiment can be obtained.

Furthermore, in the present embodiment, the waste-toner collecting device 30 is configured so as to collect and store therein the non-transferred toner on the photosensitive drum 11 collected by the cleaning unit 15. Alternatively, the waste-toner collecting device can also be configured so as to collect and store therein the non-transferred toner collected by the intermediate-transfer-belt cleaning unit for cleaning the intermediate transfer belt 17 as the image carrier. In this case, the drive control is performed so that the driving conditions of the screw member 32 (leveling member) are varied based on the information of the image formed on the intermediate transfer belt 17 (image carrier), and the control is also provided so that the switching of the driving conditions of the screw member 32 is performed after a delay time during which the non-transferred toner T (waste toner) collected in the intermediate-transfer-belt cleaning unit reaches the waste-toner collector.

Moreover, the waste-toner collecting device 30 can be configured so as to collect and store therein the non-transferred toner collected by the cleaning unit 15 and the non-transferred toner collected by the intermediate-transfer-belt cleaning unit.

Furthermore, the waste-toner collecting device 30 can be configured so as to simultaneously collect and store therein the developer degraded in the developing unit 13 together with the waste toner collected by the cleaning unit.

Even in these cases, the same effect as that of the present embodiment can be obtained.

In the present embodiment, the present invention is applied to the waste-toner collecting device 30 provided in the tandem-type color image forming apparatus in which the photosensitive drums 11Y, 11C, 11M, and 11BK and the cleaning units 15Y, 15C, 15M, and 15BK are arranged. However, the present invention is obviously applicable to the waste-toner collecting device provided in a monochrome image forming apparatus (or a mono-color image forming apparatus) in which a single photosensitive drum and a single cleaning unit are arranged. In this case, also, the drive control is performed so that the driving conditions of the screw member 32 (leveling member) are varied based on the information of the image formed on the single image forming apparatus (image carrier), and the control is also provided so that the switching of the driving conditions of the screw member 32 is performed after a delay time during which the non-transferred toner T (waste toner) collected in the single cleaning unit reaches the waste-toner collector, thus obtaining the same effect as that of the present embodiment.

The detection unit for detecting that the waste toner T collected in the waste-toner collector 31 reaches a predetermined height is not limited to the one disclosed in the present embodiment. For example, a transparent window portion for passing light therethrough is provided in a part (which corresponds to a height position of the waste toner which is in its full state or in its pre-full state) of the waste-toner collector 31, light is caused to pass through the window portion from the outside, and whether or not reflected light is present is detected by a light-receiving element, so that a full state (or pre-full state) may be detected. Even if the detection unit is configured in the above manner, the same effect as that of the present embodiment can be obtained.

The present invention is not limited to the present embodiment, and thus it is obvious that the present embodiment may be changed if necessary to any case other than that indicated in the present embodiment within the scope of technical idea of the present invention. Moreover, the number, the positions, and the shapes or the like of the components are not limited to these of the present embodiment, and thus can be set to the number, positions, and shapes or the like appropriate for implementing the present invention.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A waste-toner collecting device for collecting non-transferred toner as waste toner remaining on an image carrier, the waste-toner collecting device comprising:

a waste toner collector that communicates with a cleaning unit for removing non-transferred toner from the image carrier via a conveying path, and collects and stores therein the non-transferred toner as waste toner conveyed from the cleaning unit via the conveying path; and a leveling member that levels waste toner accumulated inside the waste toner collector, and a drive of which is controlled so that driving conditions thereof are varied based on information of an image formed on the image carrier, wherein switching of the driving conditions of the leveling member is controlled so as to be performed after a delay time during which the non-transferred toner collected in the cleaning unit reaches the waste-toner collector via the conveying path, wherein the leveling member is any one of a screw member, a coil member, and a stirring member which are rotatably driven in a predetermined direction, and is controlled to be driven so that when an image area of an image formed on the image carrier is large, then a driving rate or a rotational speed per unit time of the leveling member is increased, and when an image area of an image formed on the image carrier is small, then the driving rate or the rotational speed per unit time is reduced.

2. The waste-toner collecting device according to claim 1, wherein the drive of the leveling member is started and stopped in association with a start and an end of a series of image forming operations, and in a period of time equivalent to a time from the start of the drive to movement of the non-transferred toner through the conveying path passes, the leveling member is controlled to be driven on a same driving condition as a last driving condition in a previous series of image forming operations.

3. The waste-toner collecting device according to claim 1, wherein the image carrier includes a plurality of image carriers, and the leveling member is controlled so that switching of the driving conditions is performed after a delay of a time required for an image carrier, of the plurality of image carriers, with a shortest time from when non-transferred toner is collected in the cleaning unit to when the non-transferred toner reaches the waste toner collector via the conveying path.

4. The waste-toner collecting device according to claim 1, wherein the image carrier includes a plurality of image carriers, and the leveling member is controlled to be driven so that the driving conditions are varied based on an image area of an image, formed on an image carrier, which is a largest image area among images formed on the plurality of image carriers.

5. The waste-toner collecting device according to claim 1, further comprising a detection unit configured to detect that the waste toner collected in the waste toner collector reaches a predetermined height, wherein the leveling member conveys the waste toner collected in the waste toner collector toward a position of the detection unit.

6. A process cartridge detachably installed to a body of an image forming apparatus, comprising the waste-toner collecting device according to claim 1, the image carrier; and the cleaning unit, which are integrally mounted in the process cartridge.

7. An image forming apparatus comprising the waste-toner collecting device according to claim 1, the image carrier, and the cleaning unit.

* * * * *